US006066025A

United States Patent [19]

Wisniewski

[11] Patent Number: 6,066,025

[45] Date of Patent: May 23, 2000

[54] TOY WITH MUSICAL STAFF TRACK AND MOVEABLE NOTE TILES

[76] Inventor: John M. Wisniewski, 2256 N. 64 St., Wauwatosa, Wis. 53213

[21] Appl. No.: 09/148,358

[22] Filed: Sep. 4, 1998

Related U.S. Application Data

[60] Provisional application No. 60/057,933, Sep. 5, 1997.

[51] Int. Cl.[7] ..... A63H 19/14; A63H 3/52; A63H 29/24; G10D 13/08

[52] U.S. Cl. ..... 446/410; 446/408; 446/463; 84/402; 104/DIG. 1

[58] Field of Search ..... 446/397, 404, 446/408, 409, 410, 441, 442, 444, 447, 498, 463, 467; 434/230, 433; 84/402, 403, 404, 405; 104/DIG. 1, 53; 105/29.2, 157.2, 238.2

[56] References Cited

U.S. PATENT DOCUMENTS

| | | | |
|---|---|---|---|
| 3,433,110 | 3/1969 | Stanton | 104/DIG. 1 X |
| 3,448,649 | 6/1969 | Tobari | 104/DIG. 1 X |
| 3,453,921 | 7/1969 | Lohr et al. | 104/DIG. 1 X |
| 3,532,022 | 10/1970 | Genin | 446/410 X |
| 3,590,679 | 7/1971 | Law . | |
| 3,650,468 | 3/1972 | Ewe . | |
| 4,116,084 | 9/1978 | Masuda | 446/463 X |
| 4,540,380 | 9/1985 | Kennedy et al. | 446/463 |
| 5,349,129 | 9/1994 | Wisniewski . | |
| 5,454,512 | 10/1995 | Wilson . | |
| 5,496,179 | 3/1996 | Hoffman . | |
| 5,816,886 | 10/1998 | Cusolito | 446/410 X |

FOREIGN PATENT DOCUMENTS

| | | | |
|---|---|---|---|
| 740158 | 8/1966 | Canada | 446/410 |
| 2151388 | 7/1985 | United Kingdom | 446/410 |

*Primary Examiner*—D. Neal Muir
*Attorney, Agent, or Firm*—Quarles & Brady

[57] ABSTRACT

A musical toy includes a train-like vehicle traveling on a track which includes visual indicia representative of a standard nine note musical staff. Note tiles having first fastener halves may engage with second fasteners at predetermined locations on the track corresponding with the locations of notes on the represented staff. Switch operators extending down from the train may engage the note tiles to play the music so represented by the note tiles and track in the staff and note configuration.

12 Claims, 4 Drawing Sheets

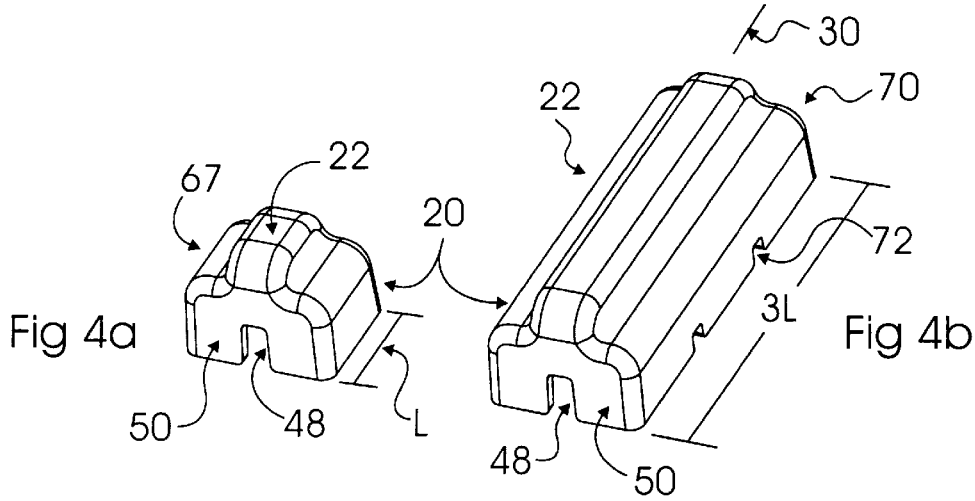
Fig 4a
Fig 4b
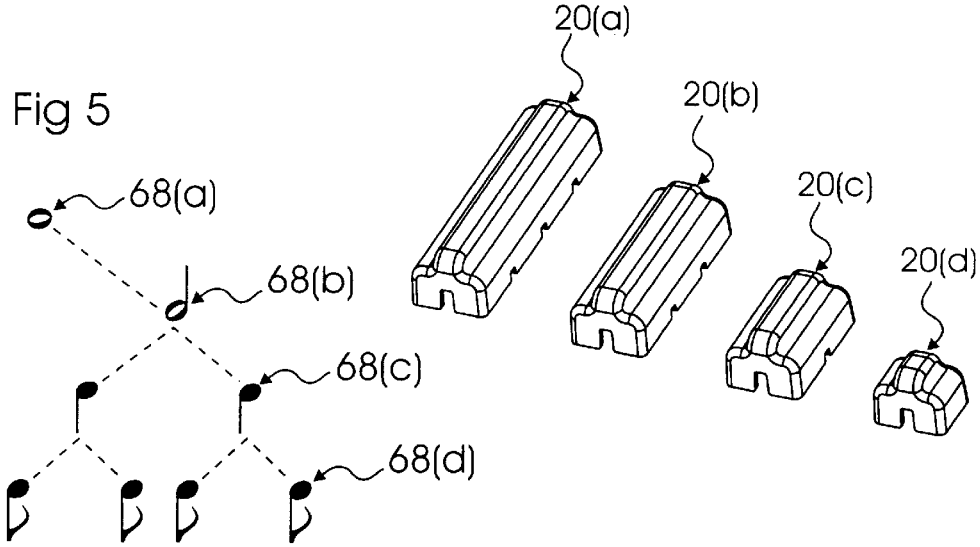
Fig 5
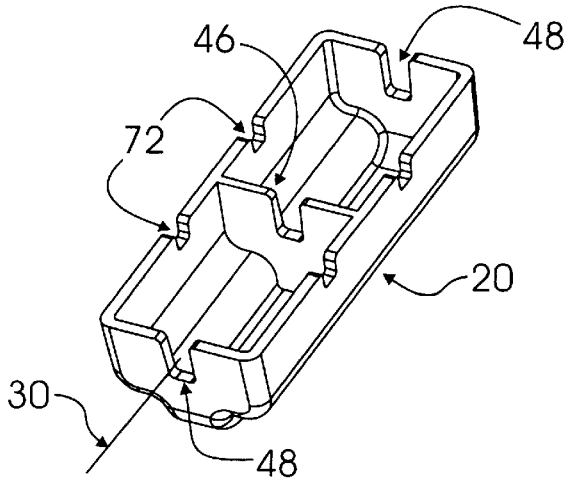
Fig 6

TOY WITH MUSICAL STAFF TRACK AND MOVEABLE NOTE TILES

CROSS-REFERENCE TO RELATED APPLICATIONS

This application is based on U.S. provisional application Ser. No. 60/057,933 filed Sep. 5, 1997 entitled Musical Train Toy. The benefit of this provisional application is hereby claimed.

STATEMENT REGARDING FEDERALLY SPONSORED RESEARCH OR DEVELOPMENT

BACKGROUND OF THE INVENTION

The present invention relates to musical toys and in particular to a musical vehicle that runs on a track representing the standard musical staff on which note tiles may be placed to be played by the vehicle.

Toy trains that play music when they run are well known in the art. Spring or battery powered trains including a music box or the like play a tune as they move across a track or a floor. Different tunes may be played by replacing a portion of the music box such as the disk or drum holding pins which engage a sound producing mechanism. Such trains provide limited play value insofar as the songs are either fixed or selected from a fairly narrow repertoire.

In order to increase the toy play value, an alternative design may be adopted which allows the child to compose his or her own music that the train may play as it moves along. U.S. Pat. No. 3,590,679, for example, describes one such train in which the ties of a rail-road type track are xylophone bars which may be struck by the train as it travels along the track. The ties are replaceable so that by proper selection and sequencing of the ties, an arbitrary melody may be played. Nevertheless, the number of tunes that may be played with this device is severely limited for practical implementations by the number of ties that can be provided. For example for a simple eight note melody, sixty-four different tone bars would be required to allow complete compositional flexibility even constrained to a single octave. Typically, a child will find that one or more notes required for the melody has been exhausted.

Also, the xylophone-type train, while allowing greater creative input by the child, uses compositional metaphor (ties on a track) that is foreign to conventional musical notation, thus failing to take advantage of a valuable educational opportunity for early musical training.

What is needed is a musical toy providing great flexibility in composing simple melodies and that provides the groundwork for early exposure to musical composition.

BRIEF SUMMARY OF THE INVENTION

The present invention provides a toy vehicle and track, the latter depicting the five lines and four spaces of a standard musical staff. Detachable note tiles may be snapped into different transverse positions onto the surface of the track approximating the position of notes on the staff and having different lengths to represent different note durations. The train traveling along the track plays notes according to the position of the note tiles and their length in the direction that the train travels.

Specifically the present invention provides a musical toy including a vehicle with a carriage supported by wheels and containing a musical instrument having a plurality of keys actuable to produce corresponding musical notes. The musical instrument is held by the carriage so as to expose the keys therebelow. A plurality of note tiles having upper surfaces holding actuator elements and lower surfaces holding first fastener halves may be attached to a track, the latter which has two outside rails extending in parallel configuration of a size and shape to engage the wheels of the vehicle. The track has second fastener halves to releasably receive the first fastener halves of the note tiles in engagement so that the actuator element of the note tiles may actuate the keys of the musical instrument when the vehicle passes over the engaged note tiles. The track further includes longitudinally extending indicia representing five lines and four spaces of the musical staff and the second fastener halves are transversely positioned so that the note tiles may be placed atop one of the five lines or the four spaces therebetween as notes are placed on a musical staff at one of a plurality of positions along the track.

Thus, it is one object of the invention to provide a musical toy allowing musical compositions by small children wherein the result resembles standard musical notation.

It is another object of the invention to allow a limited collection of note tiles to produce a variety of different musical compositions depending on placement of the note tiles perpendicular to the axis of the track.

The second fastener halves of the track may be positioned at regular intervals along the axis of the track.

Thus it is another object of the invention to provide an enforced precision in rhythmic quality to the music by causing the notes to be placed longitudinally at predetermined intervals.

The second fastener halves may be associated with indicia indicating a beat number associated with the second fastener half.

Thus it is another object of the invention to provide a visual indication of the rhythmic beats of notes placed on the track.

The note tiles may have different lengths as measured along the length of the track and they are engaged with the track.

Thus it is another object of the invention to provide a toy which provides variation in type of note used, e.g. whole, half and quarter, providing yet another dimension of creative possibility.

The musical instrument may play the note continuously when actuated by the note tiles or may play the note only upon initial activation by the note tile.

Thus it is another object of the invention to provide either piano-type or organ-type musical instrumentality.

The vehicle may include a motor driving the wheels to propel the vehicle and the motor may include a speed adjustment.

Thus it is another object of the invention to allow adjustment of the tempo of the music played.

The track may include curved sections so that the train may traverse a closed loop.

Thus it is yet another object of the invention to allow repetition of the music or the playing of rounds through the use of multiple vehicles on a single track.

The instrument keys may be simultaneously actuable to polyphonic music.

Thus it is another object of the invention to provide an advance over xylophone-type trains in that harmonies and simple note intervals may be produced.

The foregoing and other objects and advantages of the invention will appear from the following description. In the description, reference is made to the accompanying drawings which form a part hereof and in which there is shown by way of illustration a preferred embodiment of the invention. Such embodiment does not necessary represent the full scope of the invention, however, and reference must be made to the claims herein for interpreting the scope of the invention.

BRIEF DESCRIPTION OF THE SEVERAL VIEWS OF THE DRAWINGS

FIGS. 4*a* and 4*b* are perspective representations of two note tiles for half and quarter notes, respectively, showing the actuator elements on top of the note tiles and engaging notches receiving note ridges and measure ridges of the track;

FIG. 5 is a pictorial representation of the relationship between note tile lengths and notes used in standard musical notation and showing indicia placed on the note tiles to reflect this correspondence;

FIG. 6 is a figure of the underside of the half note tile of FIG. 4 showing internal structure and grooves for accepting note and measure ridges of the track;

DETAILED DESCRIPTION OF THE INVENTION

Figure 1:
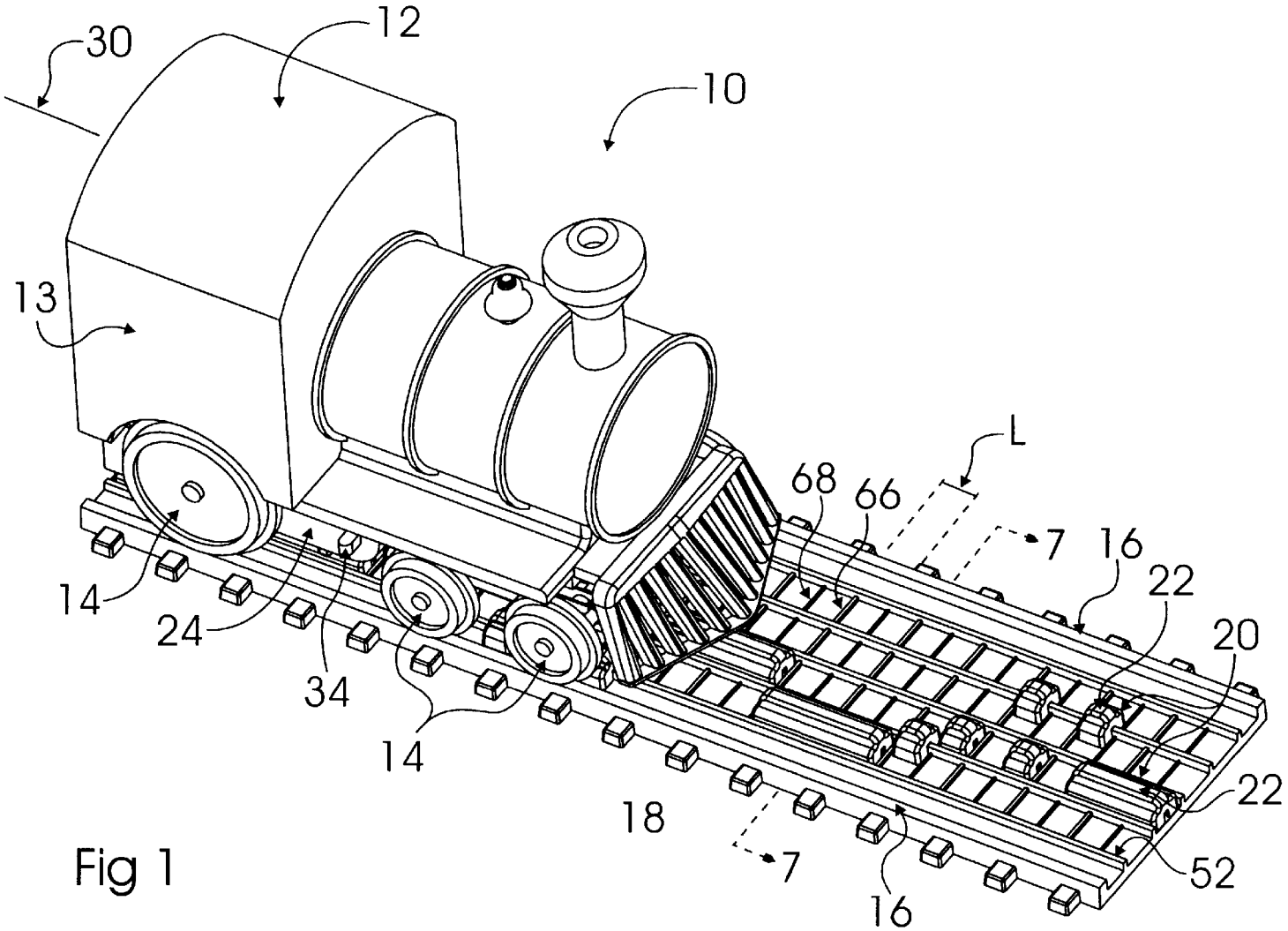
FIG. 1 is a perspective view of the toy of the present invention including a housing representing a train engine and incorporating a musical instrument held on a chassis, and further showing a track on which the chassis may ride, the track providing indicia representing a standard musical staff of one octave having various note tiles placed thereon.

Referring now to FIG. 1, a musical toy 10 of the present invention includes a vehicle, in this case a train 12, having flanged wheels 14 engaging upwardly extending outer rails 16 of a track 18 to move thereon in a longitudinal direction 30. Placed at various locations on the upper surface of the track 18 are note tiles 20 having upwardly extending actuator ridges 22 as will be described further below.

Figure 2:
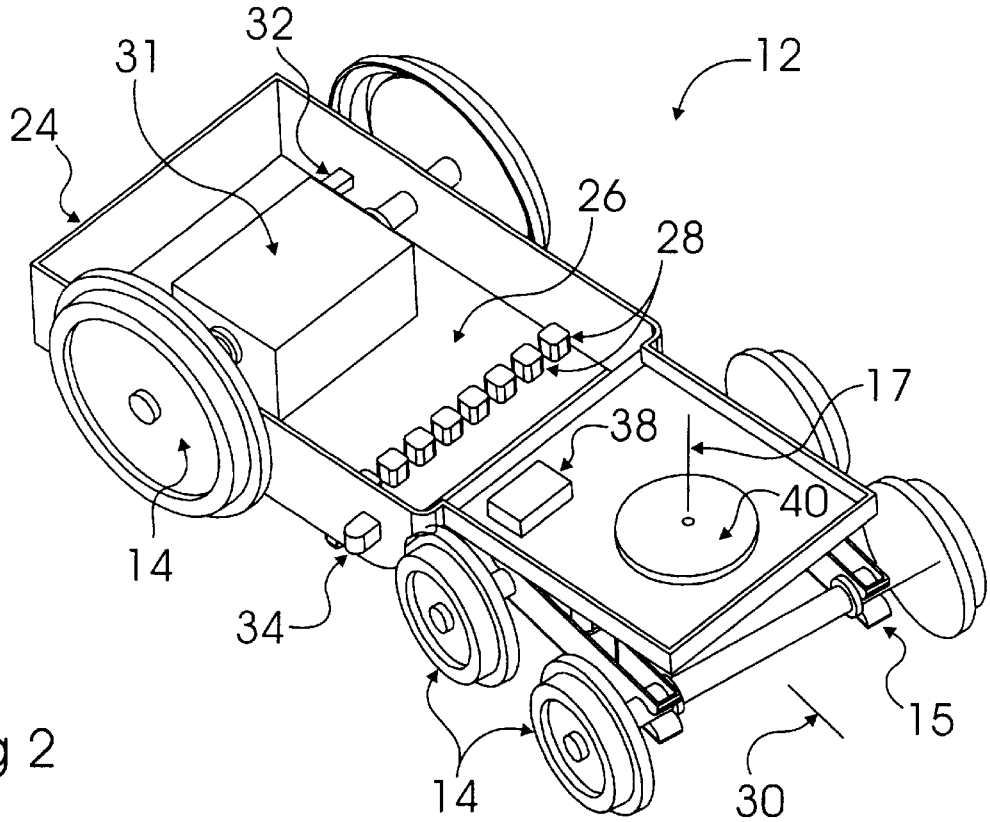
FIG. 2 is a view of the carriage of the train of FIG. 1 without the housing showing the engagement of wheels with a motor unit and showing a plurality of switch operators extending through the bottom of the carriage to be engaged by the note tiles.

Referring now also to FIG. 2, the train 12 rides upon a carriage 24 holding the wheels 14 for rotation and providing a bottom surface 26 which travels along the upper surface of track 18 above the actuator ridges 22 of the note tiles 20 when the train 12 moves therealong. Supported by the bottom surface 26 is a transverse array of nine switch operators 28. The operators 28 extend through the bottom surface of the bottom surface 26 to be pressed upward by actuator ridges 22 of different note tiles 20 when a note tile passes beneath an operator 28.

The front two pairs of wheels 14 are attached to a truck 15 that may swivel about vertical axis 17 to allow the train to navigate limited radius curves according to methods well known in the art. The rear wheels 14 are connected to a motor unit 31 such as may a be battery powered electric motor or a spring motor or the like and which provides for automatic propulsion of the train 12 along the track 18. The motor unit 31 may include an actuator lever 32 controlling its speed and thus the speed that the train 12 passes along the track 18. As will be understood from the description that follows, the lever 32 may thus control the tempo of the played music.

Figure 3:
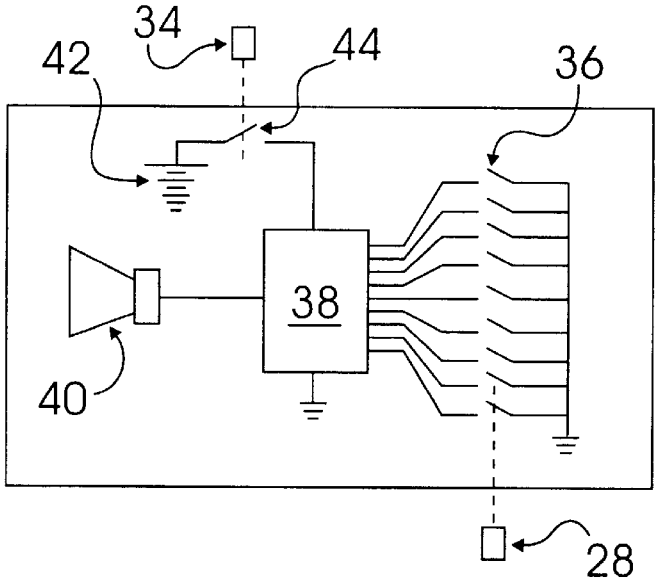
FIG. 3 is a schematic block diagram of the electrical circuitry actuated by the actuators of FIG. 2 to produce polyphonic music.

Referring now to FIGS. 2 and 3, each operator 28 may press one of a different bank of eight single pole, single throw switches 36 having one side connected to a ground connection and the other side connected to an input of a sound integrated circuit 38. Sound integrated circuit 38 connects to a speaker 40 and receives a power from a set of batteries 42 through the on/off switch 44 actuated by operator 34 extending from the side of the carriage 24 so as to be accessible when the train housing 13 is on the carriage 24.

As configured, one or more tones may be electrically generated by the sound integrated circuit 38 when particular ones of the switches 36 are pressed. Sound integrated circuits are commercially available from a number of suppliers.

Referring now to FIGS. 4*a* and 4*b*, each note tile 20 is a generally rectangular concave shell molded of a material such as a thermoplastic so as to be press fit into engagement with elements of the track 18 as will be described. The upper surface of the note tiles 20 include actuator ridges 22 extending longitudinally when the train 12 travels along the track 18.

Figure 7:
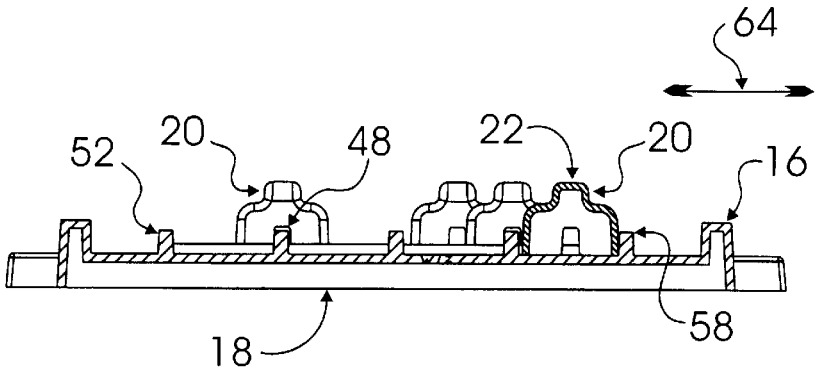
FIG. 7 is a cross-sectional view taken along line 7—7 of FIG. 1 showing engagement of the note tiles of FIGS. 4*a* and 4*b* with the track of FIG. 1 on note ridges or between note ridges by press fit.

Referring now also to FIG. 6 and 7, the concave lower surface of the note tiles 20 include transverse stiffening ribs 46 and having centered notches 48 corresponding to centered notches 48 in longitudinally opposed end panels 50 of the note tiles 22. The notches 48 may engage one of five note ridges 52 extending longitudinally along the track 18 and spaced apart from other note ridges 52 in a transverse direction. Each note ridges 52 is an upwardly extending rail generally parallel to the rails 16 along which the train travels. The notches 48 may be wedge shaped so as to tightly engage against corresponding wedge shaped note ridges 52.

Figure 8:
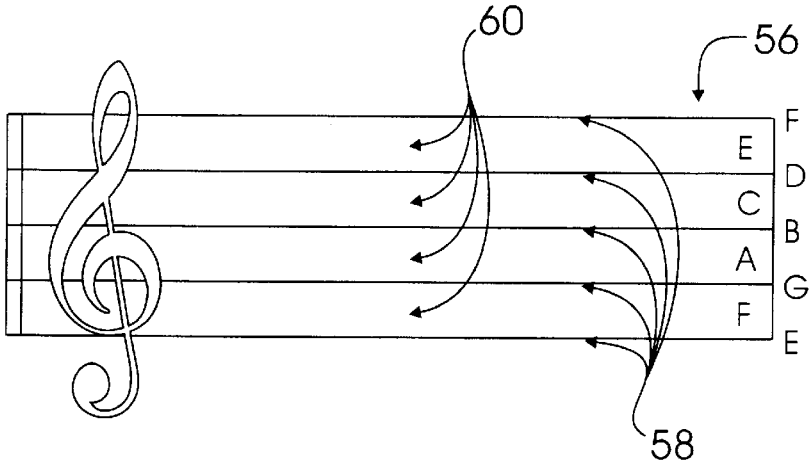
FIG. 8 is a graphic representation of a standard musical staff showing the notes corresponding to lines and spaces.
Figure 9:
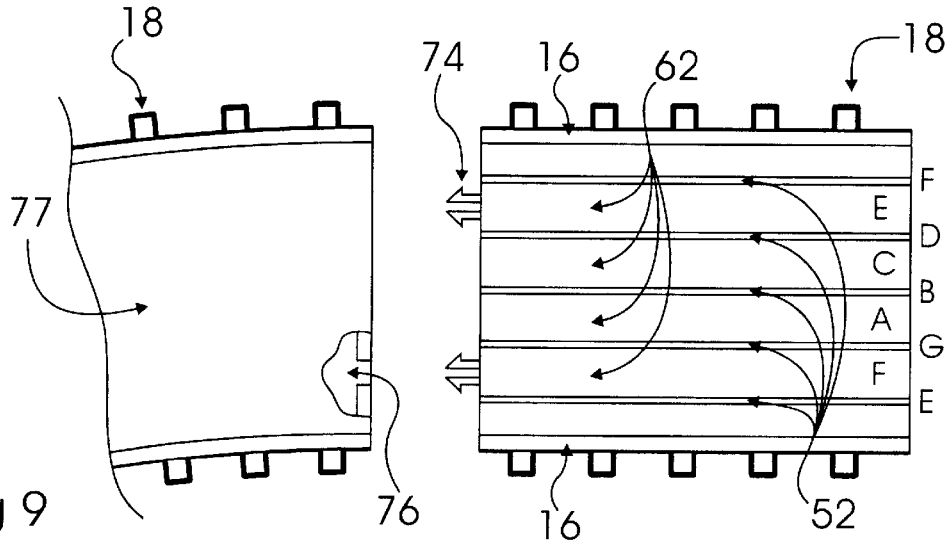
FIG. 9 is a plan view of the track of FIG. 1 showing the corresponding note ridges and spaces and their representative notes, and showing tabs allowing track sections to be connected with other track sections that are either straight or curved.

Referring now to FIG. 8, a conventional octave staff 56 is shown having five lines 58 and four spaces 60, the spaces corresponding to the letters F, A, C, E (in ascending order) and the lines corresponding to the notes E, G, B, D, F. Referring to FIG. 9, the five note ridges 52 correspond visually to the lines 58 of the stave and provide therebetween four channels 62 corresponding to the spaces 60 of the staff 56.

Referring now to FIG. 7, the notches 48 of the note tiles 20 may thus engage any one of the note ridges 52 allowing the note tiles 20 to be positioned along a pitch direction 64 in any one of five different locations corresponding generally to notes E, G, B, D, F. Alternatively, the note tiles 20 may be placed between the note ridges 52 in the channels 62 to be press fit with their opposed transverse walls engaged by adjacent note ridges 52 in any one of four locations corresponding generally to the notes F, A, C, E.

Referring again to FIG. 4*a*, for a note tile 22 representing an eighth note 67, its end panels 50 are separated by a unit distance L which, referring to FIG. 1, equals the separation of a set of transversely extending measure rails 66 and 68 crossing the note rails 52 on the upper surface of the track 18. The measure rails 66 and 68 represent a regular fraction of a measure such as a beat, allowing the eighth note tile 67 to fit at regular longitudinal locations between any two measure rails 66 and 68. Thus precision in rhythm may be enforced by means of the measure rails 68 and 66.

Referring to FIG. 4*b* for longer note tiles, for example, half note tile 70, having a separation of end panels 50 equal to 3L, measure rail notches 72 are cut every L distance in the side panels so as to allow the note tile 70 to be placed also at regular intervals of L along the track but spanning several of the measure rails 68 and 66.

Rails 66 and 68 may be visually distinguishable either by shape or color as to provide an indication of the particular beat represented by the measure rails 68 and 66, for example, in 2/4 time. Alternatively, it will be understood that distinctions may be made between sets of four adjacent measure rails 68 and 66 to provide more metrical resolution. Further numbers or other indicia may be placed near these rails for guidance of the child.

Referring again to FIGS. 4 and 5, the longitudinal length of the note tiles 20 corresponds to the type of note represented. As shown in FIG. 5, four different note tiles 20*a* through 20*d* may correspond to four types of note from whole note 68*a* through eighth note 68*d*. Depending on the circuitry and configuration of the sound integrated circuit 38, the meaning of the different length of note tiles 20*a* through 20*d* may either be the separation of a played note from the next note, for example, as played on a piano, or the duration of the note, for example as played on an organ. It will be understood that the actuator ridge 22 thus need not be continuous but may be only an initial leading edge of the note tile 20. The symbol for the particular note 68*a* through 68*d* may be embossed or hot stamped on the surface of the note tiles 20*a* through 20*d*. The different note tiles 20 may also be given different colors to facilitate their selection by the child. The length of each note tile 20 is preferably an even integer multiple of the length of shorter note tiles 20 so as to correspond with standard musical convention.

Referring again to FIG. 9, track 18 is preferably fabricated sections, each section having at one longitudinal end attachment fingers 74 engaging corresponding attachment sockets 76 on the opposed longitudinal end of an adjacent track 18. Further, it will be recognized that curved track sections 77 may be produced allowing for loops of track to be created. Clearly other train-type track conventions may be blended with the musical capabilities of the present invention allowing, for example, switch sections and multiple loops. In a looping configurations, multiple trains 12 may be placed on a track to provide for Rondo-type arrangements.

The above description has been that of a preferred embodiment of the present invention and it will occur to those that practice the art that many modifications may be made without departing from the spirit and scope of the invention. For example, the note tiles may be augmented with a percussion line using standard percussion notation as is understood in the art. In this case, the sound integrated circuit 38 is programmed to produce percussive effects in addition to or as an alternative to the notes described. While press fitting of the tiles 20 into the track 18 is described, it will be recognized that other means of attachment may be used to provide the same benefit. The present invention may be used with printed materials providing a visual indication of a setting up of the track and showing the correspondence between the notes and the tiles which differ primarily in the physical length of the tiles along axis 30. A number of different types of musical instruments may be employed including mechanical equivalents to the electronic device described herein. The music produced by the sound integrated circuit must be understood to include not only notes of a chromatic scale but optionally percussive and other sound with musical potential. It will be recognized that the mechanically actuated electrical switches described may be substituted by other sensing mechanisms including photodiodes detecting reflected light or magnetic or eddy current-type detection systems as are well known in the art. In order to apprise the public of the various embodiments that may fall within the scope of the invention, the following claims are made.

I claim:

1. A musical toy comprising:

(a) a vehicle having a carriage supported by wheels;

(b) a musical instrument having a plurality of transversely arrayed keys actuable to produce corresponding musical notes, the musical instrument held by the carriage of the vehicle to expose the keys therebelow;

(c) a plurality of note tiles having an upper surface holding an actuator element and a lower surface having a first fastener half;

(d) a track having two outer rails extending in parallel configurations so the vehicle may move along the track in a longitudinal direction guided by the rails, the track further having a plurality of second fastener halves to releasably receive the first fastener halves of the note tiles in engagement at different transverse locations so that the actuator elements of the note tiles may actuate the keys of the musical instrument when the vehicle passes over the engaged note tiles; the track further having longitudinally extending indicia representing five lines and four spaces of a musical staff wherein the second fastener halves are positioned so that the note tiles may be placed atop one of the five lines or in the four spaces therebetween, as notes are placed on a musical staff at one of a plurality of transverse locations along the track;

whereby music may be composed and played by movement of the vehicle in the longitudinal direction;

wherein the note tiles have different longitudinal extent when placed on the track and wherein the longitudinal extent are even integer multiples of each other.

2. The musical toy of claim 1 wherein the track further includes transversely extending indicia representing regular portions of a musical measure.

3. The musical toy of claim 1 wherein the second fastener halves are repeated periodically in the longitudinal direction along the track to allow the note tiles to be placed in different longitudinal locations and wherein the longitudinal spacing of the second fastener halves enforces regular metrical patterns of the music.

4. The musical toy of claim 1 wherein the first and second fastener halves are interengaging ridges enforcing a single rotational orientation of the note tiles with respect to the track.

5. The musical toy of claim 1 wherein said track is comprised of a plurality of releasably attached track segments selected from the group consisting of: rectilinear track sections, arcuate track sections.

6. The musical toy of claim 1 wherein said track forms a loop causing the vehicle to repeatedly play the music as it travels around the loop of the track.

7. The musical toy of claim 1 wherein the musical instrument responds to multiple key actuations to play multiple tones.

8. The musical toy of claim 1 wherein said vehicle includes a motor connected to at least one of the wheels for moving the train along the longitudinal direction.

9. The musical toy of claim 8 wherein the motor includes a speed control controlling the speed of longitudinal movement and hence a tempo of music.

10. The musical toy of claim 1 wherein the note tiles include visual indicia related to their longitudinal length.

11. The musical toy of claim 10 wherein the visual indicia are standard note symbols selected from the group consisting of whole notes, half notes, quarter notes and eighth notes.

12. A musical toy comprising:

(a) a musical instrument having a plurality of transversely arrayed keys actuable to produce corresponding musical notes, a musical instrument held by a carriage to expose keys on a track side;

(b) a plurality of note tiles having a first surface holding an actuator element and a second surface opposed to the first surface holding a first fastener half;

(c) a track having two outer rails extending in parallel configurations and mounted so as to move with respect the carriage and the keys, the track further having a plurality of second fastener halves to releasably receive the first fastener halves of the note tiles in engagement at different transverse locations so that the actuator elements of the note tiles may actuate the keys of the musical instrument when the engaged note tiles pass the carriage;

the track further having longitudinally extending indicia representing five lines and four spaces of a musical staff wherein the second fastener halves are positioned so that the note tiles may be placed atop one of the five lines or four spaces therebetween as notes are placed on a musical staff at one of a plurality of transverse locations along the track;

whereby music may be composed and played by movement of the track with respect to the carriage in a longitudinal direction;

wherein the note tiles have different longitudinal extent when placed on the track and wherein the longitudinal extent are even integer multiples of each other.

* * * * *